United States Patent [19]

Dassler

[11] Patent Number: 4,614,046

[45] Date of Patent: Sep. 30, 1986

[54] SHOE SOLE HAVING A MIDSOLE CONSISTING OF SEVERAL LAYERS

[75] Inventor: Armin A. Dassler, Herzogenaurach, Fed. Rep. of Germany

[73] Assignee: PUMA-Sportschuhfabriken Rudolf Dassler KG, Fed. Rep. of Germany

[21] Appl. No.: 705,002

[22] Filed: Feb. 25, 1985

[30] Foreign Application Priority Data

Aug. 6, 1984 [DE] Fed. Rep. of Germany ... 8423344[U]

[51] Int. Cl.[4] ..... A43B 13/12

[52] U.S. Cl. ..... 36/30 R; 36/37; 36/59 A

[58] Field of Search ..... 36/27, 28, 30 R, 30 A, 36/37, 38, 69, 59 A, 31, 29

[56] References Cited

U.S. PATENT DOCUMENTS

| | | | |
|---|---|---|---|
| 1,344,972 | 6/1920 | Armour | 36/59 A |
| 2,156,532 | 5/1939 | Greider | 36/82 X |
| 2,378,028 | 6/1945 | Nimrick | 36/59 A |
| 2,913,837 | 11/1959 | Geuder | 36/37 |
| 4,228,600 | 10/1980 | Krug et al. | 36/30 R X |
| 4,237,627 | 12/1980 | Turner | 36/129 |
| 4,319,412 | 3/1982 | Muller | 36/29 |
| 4,364,188 | 12/1982 | Turner et al. | 36/31 |
| 4,364,189 | 12/1982 | Bates | 36/31 |
| 4,486,964 | 12/1984 | Rudy | 36/28 |
| 4,490,928 | 1/1985 | Kawashima | 36/82 X |
| 4,551,930 | 11/1985 | Graham et al. | 36/30 R |

*Primary Examiner*—Henry S. Jaudon
*Assistant Examiner*—T. Graveline
*Attorney, Agent, or Firm*—Sixbey, Friedman & Leedom

[57] ABSTRACT

A sole for an athletic shoe having an outer sole and a midsole formed of several layers, especially for running disciplines, is improved in such a way that stresses caused by pressure occurring during running and affecting the foot and the ankles are controlled in such a way that injury, especially injury to the ankles and premature fatiguing, is largely avoided. This is achieved by the midsole being comprised of a softly elastic inner part, a hard-elastic stabilizer and a cushioning piece that are formed into a unit and surrounded on all sides by a softly elastic sheathing.

25 Claims, 7 Drawing Figures

FIG. 1
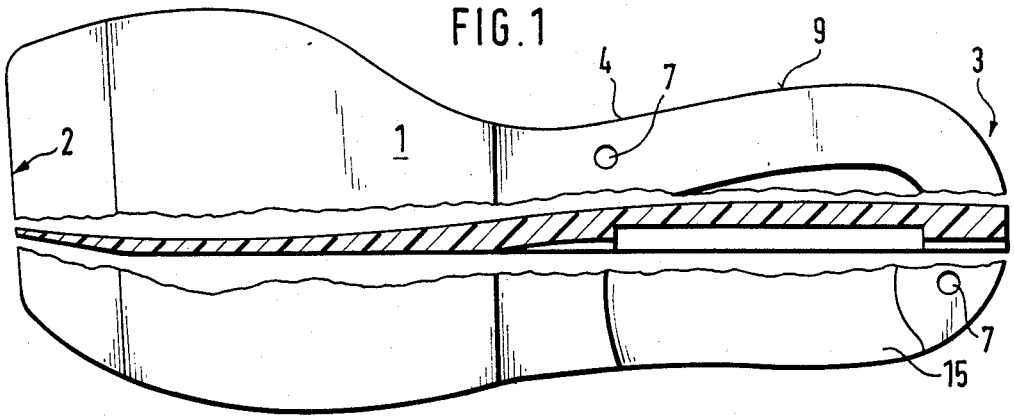
FIG. 2
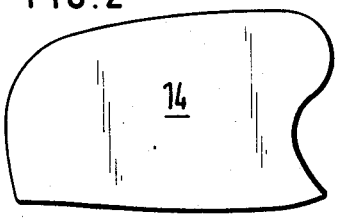
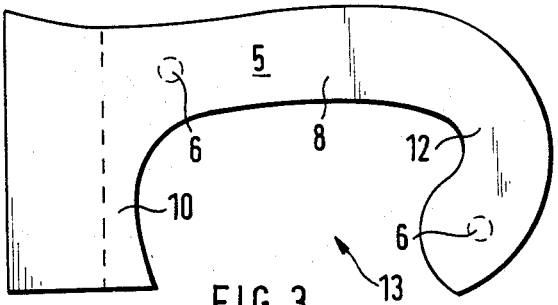
FIG. 3
FIG. 4
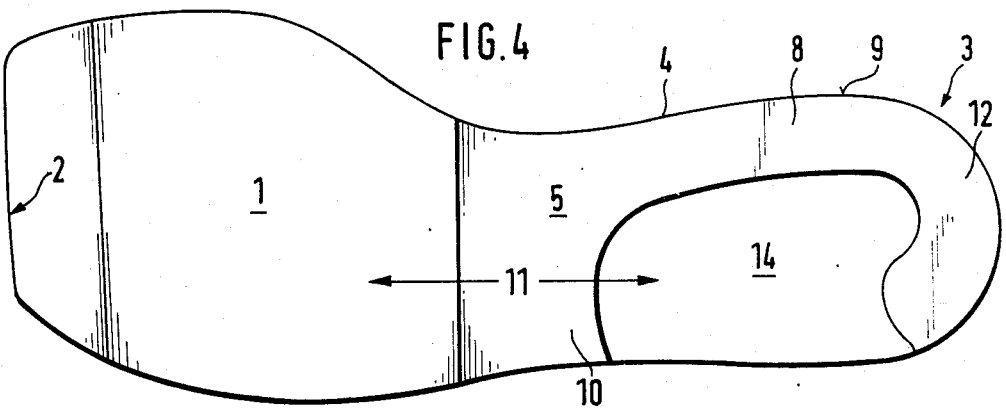
FIG. 5
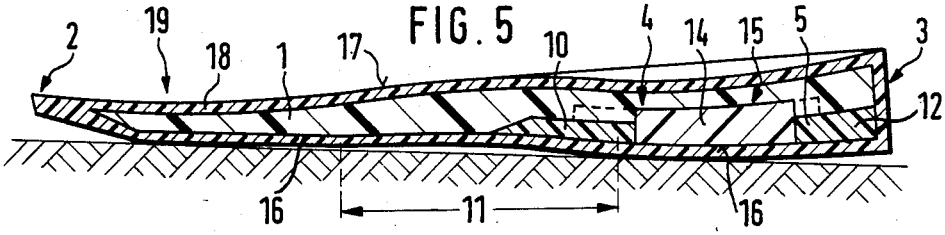

SHOE SOLE HAVING A MIDSOLE CONSISTING OF SEVERAL LAYERS

BACKGROUND AND SUMMARY OF THE INVENTION

This invention relates to a shoe sole having a midsole formed of several layers, particularly a sole of the type used for running shoes, particularly for medium and long distance running.

In the case of soles of this type, the midsole usually is formed of a material that is more elastic than that of the outer sole, preferably of a plastic foam material, foam rubber or a similar material. It is also known to develop the midsole so that it rises toward the rear in a wedge-shaped manner and to compose it of several layers. An example of such a sole can be found in U.S. Pat. No. 4,237,627.

It is a primary object of this invention to construct a shoe sole having a midsole of the initially mentioned type for athletic shoes, especially for the running disciplines, in such a way that the distribution of stress occurring during running and affecting the foot and the joints, especially the ankle and the arch of the foot, is controlled in such a way that injuries, especially injuries to the ankle, and premature fatiguing are largely avoided or even prevented. In particular, it is a particular object for a sole with a midsole is to be developed that will counteract the lateral stresses occurring during running, known as "pronation," and which twist the foot.

In this connection, it is known to incorporate a material of greater hardness and lesser resiliency into the midsole of a running shoe at the inner, medial, side in the area of the heel in order to act as a heel stabilizer that will counteract pronation. Examples of soles incorporating such stabilizing portions into the midsole can be found in U.S. Pat. Nos. 4,364,188 and 4,364,189, as well as co-pending, commonly assigned U.S. application Ser. No. 387,667, filed June 11, 1982. However, such prior art midsoles often have a somewhat patchwork external appearance and can be subject to problems resulting from penetration of wetness, particles or other substances between layers or sections. Furthermore, manufacture of such compound midsoles can be complicated and expensive, and from a practical standpoint, places limitations on the configurations which can be used for the respective portions of the midsole.

Thus, it is a further object of the present invention to provide a shoe sole having a midsole which would avoid problems of wetness, particles and other substances penetrating into the midsole and, also, would provide greater freedom to configure the various portions of different materials in optimal fashion.

In order to achieve the above-noted objects, the sole in accordance with the present invention has a midsole with a softly elastic inner part, which extends from the toe area to the heel, a hard elastic stabilizer, which is located under the softly elastic inner midsole part in a portion of the heel area, and a cushioning piece of softly elastic material, which underlies the inner midsole part in the portion of the heel area not occupied by the stabilizer. Furthermore, the unit comprised of the inner midsole part, stabilizer and cushioning piece is surrounded by a softly elastic sheathing that, advantageously, is injection-molded or cast about the unit.

By means of the softly elastic sheathing of the individual parts of the midsole, a cohesive midsole is formed which ensures its individual elements are effectively held together and may, especially, also be shaped according to the bed of the foot. The stabilizer, that may be C-shaped, L-shaped or I-shaped, counteracts the above-mentioned "pronation," while the cushioning piece absorbs the pressure affecting the heel when the foot impacts. This cushioning piece, in particular, has good spring-back characteristics so that the compression energy can be used for absorbing shocks and, therefore, makes possible an increase in performance of the athlete wearing this type of shoe. By means of the combination of these three inside elements, extremely good stability is achieved which also prevents a twisting of the rear part of the foot without impairing the required damping of pressure and rolling-off characteristics. The sheathing, finally, also causes an additional absorption of shocks while durably and firmly enclosing the individual elements. It is also useful for keeping out wetness and prevents penetration of particles or substances into the midsole that can have an eroding effect.

Furthermore, because a sheathing is molded or cast about individual formed elements to hold them together, complicated interfitting shapes can be used since relatively simple molds and molding apparatus can be used to form each element and to form the sheathed unit.

These and further objects, features and advantages of the present invention will become more obvious from the following description when taken in connection with the accompanying drawings which show, for purposes of illustration only, several embodiments in accordance with the present invention

BRIEF DESCRIPTION OF THE DRAWINGS

FIG. 1 is a bottom plan view of an inner midsole part which has been partially broken away and rotated 90 degrees to show an indicated cross-sectional profile;

FIG. 2 is a bottom plan view of a cushioning piece;

FIG. 3 is a bottom plan view of a C-shaped stabilizer;

FIG. 4 is a bottom plan view showing the structural elements of FIGS. 1 to 3 combined into a unit;

FIG. 5 shows a lateral section of a complete midsole according to the invention;

DETAILED DESCRIPTION OF THE PREFERRED EMBODIMENT

Figure 6:
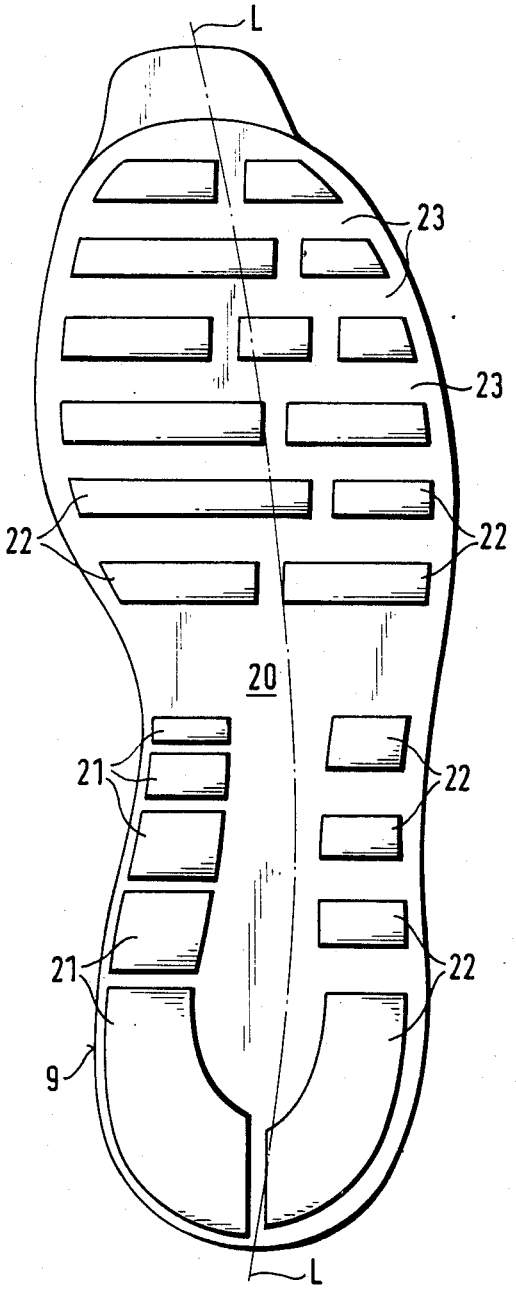
FIG. 6 is a bottom plan view showing an outer sole for use in conjunction with the midsole in accordance with a preferred embodiment of the invention.

Reference number 1 is an inner part of a midsole 19 that is formed of several parts. The inner midsole part 1 extends from the area of the tip 2 of the toe part of the sole to the heel 3 of the shoe sole. Inner part 1 consists of a softly elastic, especially of a plastic foam, material, preferably of expanded polyethylene. The height of part 1 increases in an approximately wedge-shaped manner from the tip area 2 of the sole toward the heel 3.

Starting from approximately the center of the length of the sole, the cross section of inner part 1 is decreased at least by approximately the thickness of a stabilizer 5. The stabilizer 5 (FIG. 3) may be attached, or at least held against lateral and axial shifting, in this area of reduced thickness by means of fixing elements, such as pins 6 on the stabilizer 5 that are received in corresponding holes 7 in the inner midsole part 1. Instead of the pins 6 and the holes 7, slots and bars or other suitable position fixing elements may also be provided.

The stabilizer 5 has essentially the shape of a horizontal C and consists of a hard, but spring-elastic, material, especially of hard polyurethane foam. The construction is selected in such a way that the center bend 8 extends on the inside (medial) edge 9 of the heel; that the front end bend 10 extends across approximately the area of the center to the rear half of the arch 11 of the foot; and that the rear end bend 12 extends around the end of heel 3. The stabilizer 5, on the basis of its geometric construction and firmness, therefore, counteracts pronation during running. This also especially decreases the danger that the ankle is twisted in difficult ground conditions. An L-shaped stabilizer 5 (not shown) may also be used, such corresponding to that of C-shaped without the end bend 12.

A cushioning piece 14 (FIG. 2) can be inserted, preferably with a snug fit, into the vacant space 13 (FIG. 3) created by the C-shape of the stabilizer 5. This cushioning piece 14 is made of a softly elastic plastic material, especially of soft foamed polyurethane. It has high elastic values, i.e., a high spring-back effect. Preferably, the thickness of the cushioning piece 14 is larger, especially by a factor of 1.3 to 3 times that of the stabilizer, in order to ensure the desired high degree of cushioning and spring-back effect.

The cushioning piece 14 has the additional advantage that the heel bone, when the impact of the footfall affects the outside of the heel, can enter into the volume-compressible material of the cushioning piece 14 with the result that, when an L-shaped or a C-shaped stabilizer 5 is used, the center part of the foot is at the same time supported by the front end bend 10 of the stabilizer. This prevents a "stepping-through" of the heel bone through the cushioning part 14 so that heel bone bruises resulting in injury are made practically impossible.

In order to attach the cushioning piece 14 well at the rear of midsole part 1, the latter, in the area of the vacant space 13 of the stabilizer 5, is provided with a correspondingly adapted recess 15. Advantageously, this recess 15 is so deep that the bottom side 16 of the unit formed by the three constructional inside elements, sole part 1, stabilizer 5 and cushioning piece 14, is smooth and, therefore, continuous. The top side 17 of midsole part 1 is, preferably, shaped according to the bed of the foot. The whole unit 1, 5, 14 is, finally, surrounded by a softly elastic sheathing 18, the sheathing being preferably injection-molded or cast around it. The sheathing 18 holds the unit 1, 5, 14 firmly together and, thus, forms a uniform wedge-shaped midsole 19. A polyurethane foam that is adjusted to be softly elastic is preferred as the material for the sheathing, the polyurethane foam providing an additional degree of shock absorbancy to the midsole 19.

In order to ensure a good roll-off movement, the inside sole part 1, at tip 2, is cross-sectionally shaped to extend at an acute angle toward the front by aiming the portion 16*a* of the midsole bottom side 16 diagonally upward. The stabilizer 5 also is developed so that, toward the front, it extends at a wedge-shaped acute angle. This ensures a good bending of the wedge-shaped midsole 19 in this area.

The elasticity of the individual parts is selected to be such that the sheathing 18 is the softest and most flexible, and the cushioning plate 14 has an elasticity that is between that of the inside sole part 1 and that of the stabilizer 5.

An outer sole 20 (FIGS. 6 and 7) is applied to the bottom side 16 of the midsole 19. The outer sole 20 provides a ground engaging running surface and supports the effect of the wedge-shaped midsole 19. For this purpose, the area of the inside (medial) edge 9 of the heel is developed to be harder than the remaining area, so that a spring characteristic is achieved that is similar to that of the wedge-shaped midsole 19. In the case of the illustrated embodiment, this is achieved by the fact that the outer sole 10 has protruding, ground-engaging, tread elements 21, in the area essentially below the stabilizer 5, that are harder than the tread elements 22 in the remaining area. Preferably, the harder profile elements 21 consist of the material of the body of the outer sole 20 and are, preferably, made in one piece with the outer sole 20, for example, by injection molding. The material of the outer sole 20, preferably, consists of a plastic material with a polyurethane base that is very abrasion-proof and enriched with benzolene. This plastic material wears extremely well and is also flexible. The tread elements 22, consisting of a softer, spring-elastic plastic material, are inserted or glued into the outer sole 20 or are directly molded into it. Preferably, the tread elements 22, and, possibly, also the harder tread elements 21, consist of, especially, web-shaped half-shells (i.e., cup-like shells), the outside bottom 24 of which forms the running surface. Consequently, tread elements 22 can deflect softly, as shown in FIG. 7.

Figure 7:
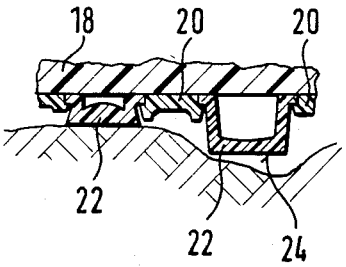
FIG. 7 shows a segment of the running sole being stressed in use, in a lateral sectional view.

The elasticity of the tread elements 21 and, possibly, also of the tread elements 22 is adjusted in such a way that, when they are stressed on a hard surface, such as asphalt, concrete or dry cross-country paths, they deflect at least over a part of their profile height, as shown in FIG. 7. The tread elements 21, 22, therefore, contribute to the cushioning of the pressure of hard impacts. However, they are firm enough that, in the case of a soft surface, especially one that is softened by rain, the tread elements 21, 22 are maintained as fully gripping tread elements which, therefore, increase the adhesive force of the sole. In the case of varying ground conditions, such as gravel, the tread elements 21, 22 cushion where stress occurs and grip where the ground is soft. On the whole, the tread elements 21, 22 provide an optimal transfer of energy and ensure a grip that cannot be achieved in any other way.

Because of the flexibility of the sole and the deformability of the tread elements, collection of dirt on the bottom of the shoe is also reduced to a minimum, thereby avoiding an associated increase in the weight of the shoe.

So that the roll-off characteristics of the shoe or the sole are not impaired by the tread elements 21, 22, it is advantageous to arrange them in parallel rows behind one another, thus, perpendicular to the running direction. The spaces 23 between the rows of tread elements form flexible bending zones, the bending capacity of which may still be further increased by the provision of grooves 25 extending essentially normal to the longitudinal axis of the sole.

According to standard DIN 7726, Page 1, a "softly elastic foam material" is a foam material which, in the case of a relatively low deformation resistance, exhibits high elastic deformability. Even when the stress through pressure is very high, the deformation is predominantly elastic.

According to the same DIN standard, a hard foam material, as is used for the stabilizer 5, is a foam material which, in the case of a relatively high deformation resistance exhibits low elastic deformability. In the case of the present invention, the stabilizer 5 consists of a "viscous-hard" foam material, thus of a type of foam material where, when the pressure-caused stress is sufficiently high, a slow but reversible deformation will take place.

Even though, in the illustrated embodiment, an essentially C-shaped stabilizer 5 is utilized, stabilizers of different shapes, especially, the essentially L-shape mentioned above, or an I-shaped stabilizer can be used on the inside of the heel in order to prevent or at least reduce pronation. An L-shaped stabilizer, as indicated, is a stabilizer 5 which, according to FIG. 4, consists of parts 8 and 10 without the end bend 12. In the case of an I-shaped stabilizer, the stabilizer parts 10 and 12 do not exist, only part 8 being provided.

It should also be appreciated that, because of the use of sheathing 18, changes in the configuration and position of elements 1, 5 and 14 can be made (or other elements added, such as in the area of the ball of the foot) without significantly affecting the process for applying the sheathing 18 to form midsole 19 since the elements can be formed individually and simply positioned upon pins within a mold cavity, the use of adhesives or complicated multi-stage molding processes being unnecessary. Furthermore, since the sheathing completely surrounds the assemblage of individual elements, they are not only firmly secured together, but the above-noted problems of wetness, particle, and substance penetration can be avoided. However, within the context of this invention, the complete surrounding of the individual elements does not preclude the possibility of some limited openings being provided through sheathing 18, so long as such openings do not significantly impact upon the stated objects. For example, one or more of elements 1, 5, 14 may be made of a contrasting color relative to that of sheathing 18, openings being provided to allow the color of aone or more of the elements to show through in a merely decorative manner or in the configuration of a trademark or the like.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. An athletic shoe sole for attachment to a shoe upper, comprising an outer sole and a midsole having several layers, wherein the midsole has a softly elastic inner part extending from an area of a tip of the toe of the sole to the heel, a hard-elastic stabilizer that extends under at least a portion of the medial side and less than all of the lateral side of a rear half of the inner part, a softly elastic cushioning piece that extends under the rear half of the inner part in areas other than that where the stabilizer extends, the inner part, the stabilizer and the cushioning piece forming an inner midsole unit, and a softly elastic sheathing surrounding said inner midsole unit on all sides.

2. An athletic shoe sole according to claim 1, wherein said sheathing is a layer that has been formed around said unit by one of injection molding and casting.

3. A shoe sole according to claim 1, wherein the softly elastic inner part of the midsole comprises a foamed polyethylene.

4. A shoe sole according to claim 1, wherein the stabilizer comprises a hard-elastic plastic foam and the cushioning piece and the sheathing comprise a softly elastic plastic foam.

5. A shoe sole according to claim 4, wherein the stabilizer, the cushioning piece and the sheathing comprise a polyurethane foam material.

6. A shoe sole according to claim 1, wherein the thickness of the softly elastic inner part increases in a wedge-shaped manner from the tip area of the sole toward the heel.

7. A shoe sole according to claim 1, wherein the rear half of the inner part is reduced in thickness by an amount corresponding to at least the thickness of the stabilizer.

8. A shoe sole according to claim 7, wherein the inner part, in the area of the cushioning piece, is reduced in thickness by an amount corresponding to the thickness of the cushioning piece.

9. A shoe sole according to claim 8, wherein the cushioning piece is thicker than the stabilizer.

10. A shoe sole according to claim 9, wherein the cushioning piece is approximately 1.3 to 3 times thicker than the stabilizer.

11. A shoe sole according to claim 10, wherein the reductions of the thickness of the inner part are shaped and arranged to enable the stabilizer and the cushioning piece to be inserted into the inner part in a manner forming a continuous, smooth bottom side.

12. A shoe sole according to claim 11, wherein the tip of the inner part of the midsole, at the bottom side, extends diagonally upwardly and forwardly at an acute angle.

13. A shoe sole according to claim 7, wherein the stabilizer and the inner part have at least two mating fixing elements.

14. A shoe sole according to claim 7, wherein the stabilizer extends at a wedge-shaped acute angle toward the front.

15. A shoe sole according to claim 1, wherein the sheathing consists of a softer, especially more volume-compressible material, than the inner part.

16. A shoe sole according to claims 1, wherein the outer sole is connected with the midsole and, in the area of an inside edge of the heel, consists of ground-engaging portions that are of a harder material than that of ground-engaging portions of remaining areas.

17. A shoe sole according to claim 16, wherein the area that is made of a harder material is located at least approximately below the stabilizer.

18. A shoe sole according to claim 16, wherein the ground engaging portions of harder and softer materials are formed by protruding tread elements.

19. A shoe sole according to claim 18, wherein the tread elements are molded to a body portion of the outer sole.

20. A shoe sole according to claim 18, wherein the tread elements of softer material are inserts within a body of the outer sole.

21. A shoe sole according to claim 18, wherein the tread elements in the harder area of the outer sole are formed of the material of which a body portion of the outer sole is formed, while the tread elements in the softer area of the outer sole are formed of a material that is softer than that of the body of the outer sole.

22. A shoe sole according to claim 21, wherein the tread elements are formed as cup-like shells, outside surfaces of the bottom of which form the ground-engaging portions.

23. A shoe sole according to claim 22, wherein the tread elements are formed in the shape of bars and extend essentially normal to a longitudinal axis of the sole.

24. A shoe sole according to claim 22, wherein the tread elements are arranged in parallel rows behind one another and spaces between the rows serve as flexible bending zones of the shoe sole.

25. A shoe sole according to claim 24, wherein the flexibility of the bending zones is increased by grooves extending essentially normal to the longitudinal axis of the sole.

* * * * *